United States Patent [19]

Granzow et al.

[11] 4,168,058

[45] Sep. 18, 1979

[54] RECORD MEMBER FEEDING DEVICE

[75] Inventors: Robert H. Granzow, Miamisburg; William J. Hale; William R. Horst, both of Dayton, all of Ohio; John F. Smallwood, Sheridan, Mich.

[73] Assignee: NCR Corporation, Dayton, Ohio

[21] Appl. No.: 856,463

[22] Filed: Nov. 30, 1977

[51] Int. Cl.[2] ..... B65H 3/08; B65H 3/44; B65H 7/14

[52] U.S. Cl. ..... 271/5; 271/9; 271/20; 271/30 A; 271/106; 271/263

[58] Field of Search ..... 271/100, 101, 20, 30 A, 271/106, 107, 263, 5, 112, 119, 120, 9, 11-15

[56] References Cited

U.S. PATENT DOCUMENTS

| | | | |
|---|---|---|---|
| 873,520 | 12/1907 | Dunnebier | 271/106 UX |
| 3,424,452 | 1/1969 | Jones | 271/100 |
| 3,754,754 | 8/1973 | Peterson | 271/122 |
| 3,795,395 | 3/1974 | Ransom et al. | 271/4 |
| 3,795,796 | 3/1974 | Shigemori et al. | 271/95 X |
| 3,806,114 | 4/1974 | Carter | 271/20 |
| 3,895,790 | 7/1975 | Hoyer et al. | 271/10 |
| 3,908,983 | 9/1975 | Long | 271/35 |
| 3,936,042 | 2/1976 | Smith et al. | 271/9 |
| 3,937,453 | 2/1976 | Hickey et al. | 271/263 X |
| 3,952,183 | 4/1976 | Abe | 271/4 X |
| 3,954,260 | 5/1976 | Morello et al. | 271/263 X |
| 3,966,191 | 6/1976 | Strobel | 271/125 |
| 3,984,659 | 10/1976 | Bilbrey | 271/35 X |
| 3,991,998 | 11/1976 | Banz et al. | 271/125 |

*Primary Examiner*—Bruce H. Stoner, Jr.
*Attorney, Agent, or Firm*—J. T. Cavender; Albert L. Sessler, Jr.

[57] ABSTRACT

A record member feeding device is disclosed for feeding record members from a stack, located in a hopper having spaced-apart surfaces positioned at one end thereof defining an opening through which the record members may be fed. A vacuum-operated, solenoid-control picking member grasps one of the record members and shifts it through the opening to a position in which it is contacted by projections on a rotatable feeding element and is moved thereby into engagement with counter-rotating take away rollers which further transport it to its desired destination.

12 Claims, 13 Drawing Figures

RECORD MEMBER FEEDING DEVICE

BACKGROUND OF THE INVENTION

The act of dispensing currency is an important and basic operation in many transactions of financial and business institutions. As financial transactions become automated and customers interact directly with the system, without teller assistance, currency dispensing must also be automated. This is particularly true with automated teller terminals located at remote sites where no human assistance is possible. In addition to those automated financial terminals, there have been limited, but effective, installations of currency dispensers at teller windows to speed the flow of customers. Application of efficient, cost-effective currency dispensing in high volume situations, such as at the supermarket checkout counter to dispense paper money as a companion to automated coin dispensers, has great potential if the cost of the unit is reasonably low.

The purpose of a currency or bill dispenser is to provide means of storing one or more denominations of paper currency and feeding a prescribed number of bills on command. The accuracy and speed of the feeding operation largely depends on the means of removing single bills from the stack of each bill denomination. Bill dispensers currently being manufactured generally employ one of two basic principles in removing a bill from the stack. One means employs a loose stack in contact with a rubber-covered friction wheel, belt, or drum. Movement of the high-friction surface, such as by rotation of the drum, will drag the bill which is in contact with the surface from the stack whereas the inter-bill friction will hold the remaining bills in the stack. The other principle employs a vacuum or suction pick-up which causes the first bill in the stack to adhere to a moving member, thereby dragging it from the stack, again allowing the remaining bills to stay with the stack. Friction rolls or transport belts then move the individual bill past checking stations and out of the machine (or into a reject hopper). Both methods often employ a reverse-moving friction surface or stationary friction drag means in contact with the back of the moving bill to further insure that only one bill is removed from the stack at a time. Reasonably good performance has been obtained from machines employing either of the above principles. However, the design typically becomes relatively complex, requiring many parts, and is critical in certain adjustments because of the need for close balance of various frictional forces.

Bill dispensers are employed at present primarily in free-standing automatic teller terminals, and in in-lobby terminals. They also have potential utility in back-office money counting operations of business establishments. To date, they have not gained wide acceptance in many applications because of their high cost, large size and limited reliability. Even in the relatively complex systems, such as automated teller terminals, bill dispensers represent a significant portion of the total cost and size of the machine.

A record member feeding device comprises an important part of a bill dispenser for feeding one bill at a time from a stack or other group of bills. Record member feeding devices also have numerous other important uses in addition to employment in a bill dispenser machanism.

SUMMARY OF THE INVENTION

This invention relates to record member feeding devices, and more particularly to means for feeding record members one at a time from a stack to another location.

In accordance with one embodiment of the invention, a record member feeding device for feeding record members from one location to another comprises a hopper in which a plurality of record members may be stored; first and second spaced-apart supporting means positioned at one end of said hopper defining an opening therebetween; biasing means operable to urge record members in the hopper against said first and second spaced-apart supporting means; rotatable means positioned in operative relation to said end of said hopper; projecting means on said rotatable means capable of engaging and moving record members brought into contact therewith; picking means capable of grasping record members from said end of said hopper, and shiftable to bring said grasped record members into contact with said projecting means on said rotatable means; and takeaway means for receiving the record member after transportation by the picking means and the rotatable means and further transporting said record member; whereby said grasped record member is removed from said hopper through said opening and transported to another location.

It is therefore an object of the present invention to provide a relatively inexpensive, efficient and versatile record member feeding device.

Another object is to provide a record member feeding device suitable for dispensing currency.

A further object is to provide a record member feeding device employing a vacuum pick-up arm for grasping one record member from a stack thereof and providing a first increment of movement thereto, a rotatable member with projections thereon for providing a second increment of movement to the record member, and a take away roller station, the rollers of which are operable to provide a third increment to a record member presented thereto, to move it to its destination.

Yet another object is to provide a record member feeding device capable of feeding record members from a stack one at a time to desired location, including means for detecting instances in which more than one record member at a time is being fed, and means for directing such improperly fed record members to a second location.

Yet another object is to provide a bill dispensing device which is capable of relatively rapid operation, is relatively insensitive to the type or thickness of paper stock, and can accommodate bills of various physical dimensions by a simple adjustment.

With these and other objects, which will become apparent from the following description, in view, the invention includes certain novel features of construction and combinations of parts, one form or embodiment of which is hereinafter described with reference to the drawings which accompany and form a part of this specification.

DETAILED DESCRIPTION OF THE PREFERRED EMBODIMENT

Figure 1:
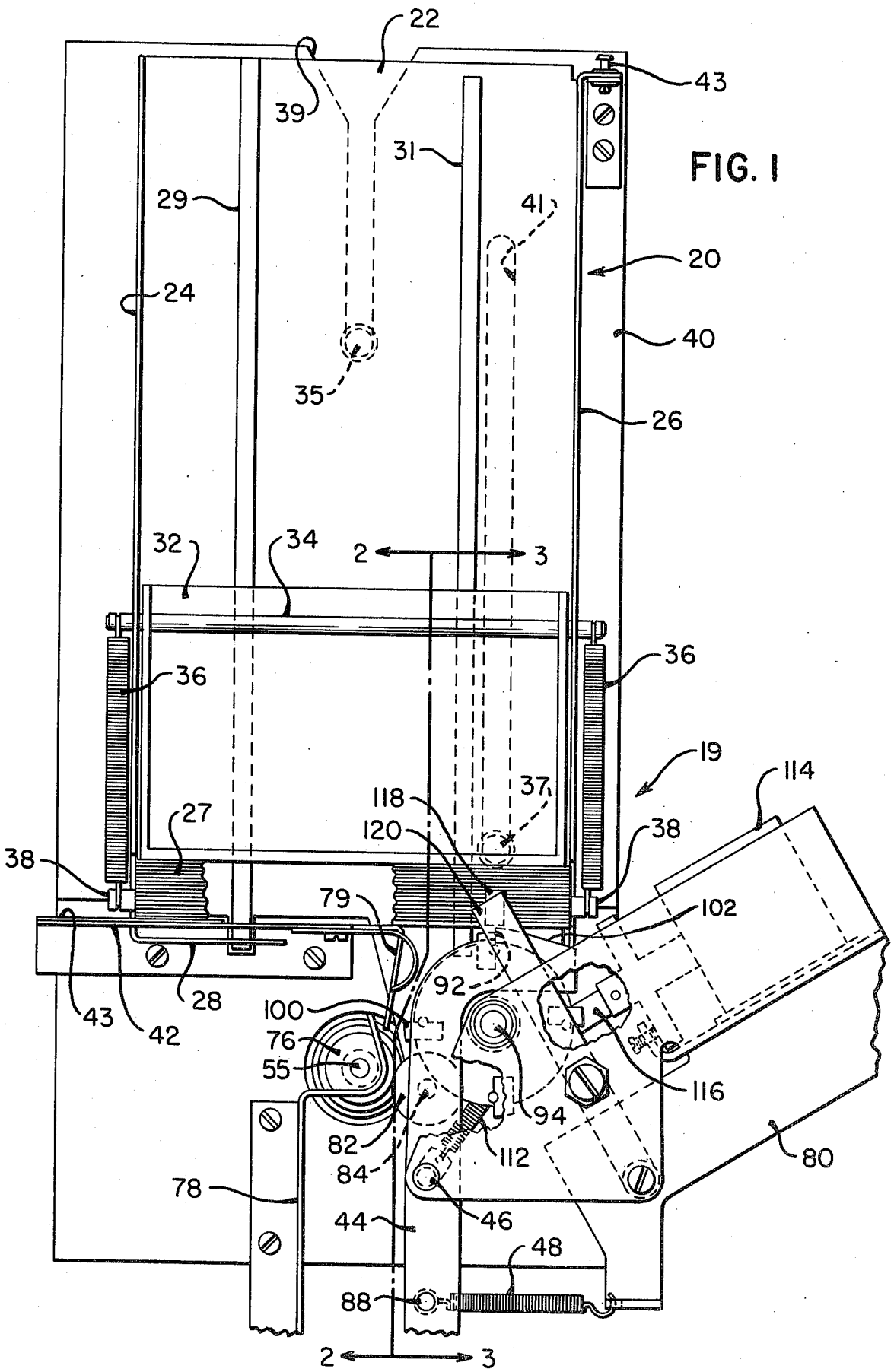
FIG. 1 is a plan view of the record member feeding device of the present invention.
Figure 6:
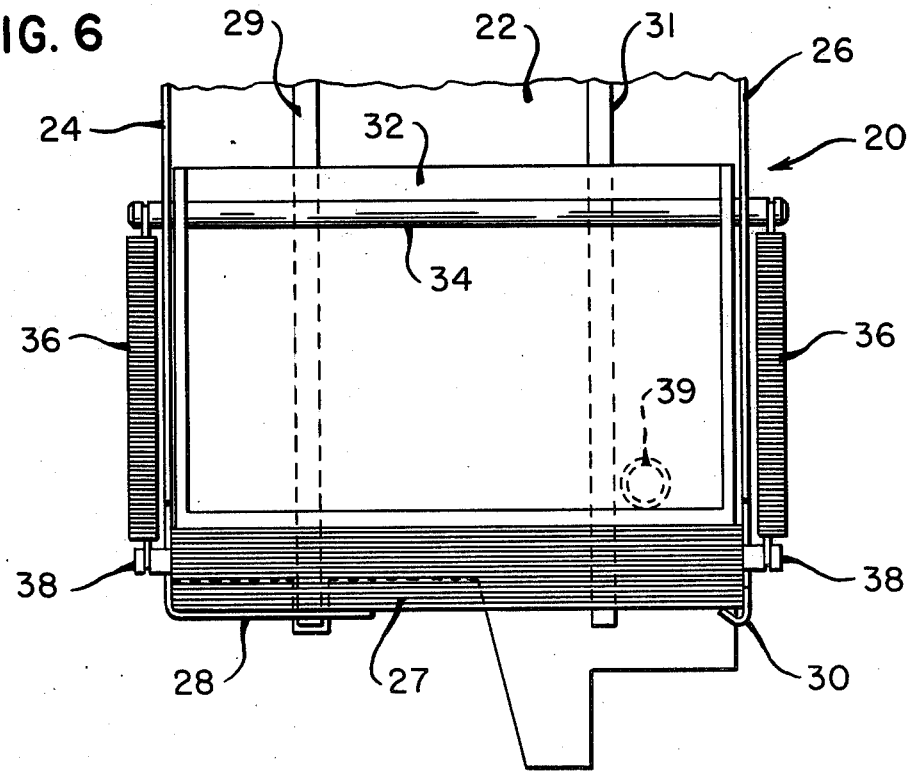
FIG. 6 is a plan view showing the hopper, in which currency or other record members may be stored preparatory to the feeding operation.

Referring now to FIG. 6, there is shown a hopper 20 having a base 22, side walls 24, 26 and partial end walls 28, 30 extending from the side walls 24, 26, respectively. Currency or other record members 27 may be stacked within the hopper 20 for feeding by a record member feeding device 19 (FIG. 1). The record members 27 are urged into engagement with the end walls 28, 30 by a pusher shoe 32, which rides on slide strips 29, 31 fixed to the base 22 and being made from a suitable material such as Teflon having a low coefficient of friction. A rod 34, fixed in the walls of the shoe 32, extends through slots 33 in the side walls 24, 26 of the hopper 20. Springs 36 extend between each end of the rod 34 and anchors 38 attached to the side walls 24, 26 and act to urge the shoe 32 against the stacked record members 27, and to compress said record members against the end walls 28, 30.

Figure 8:
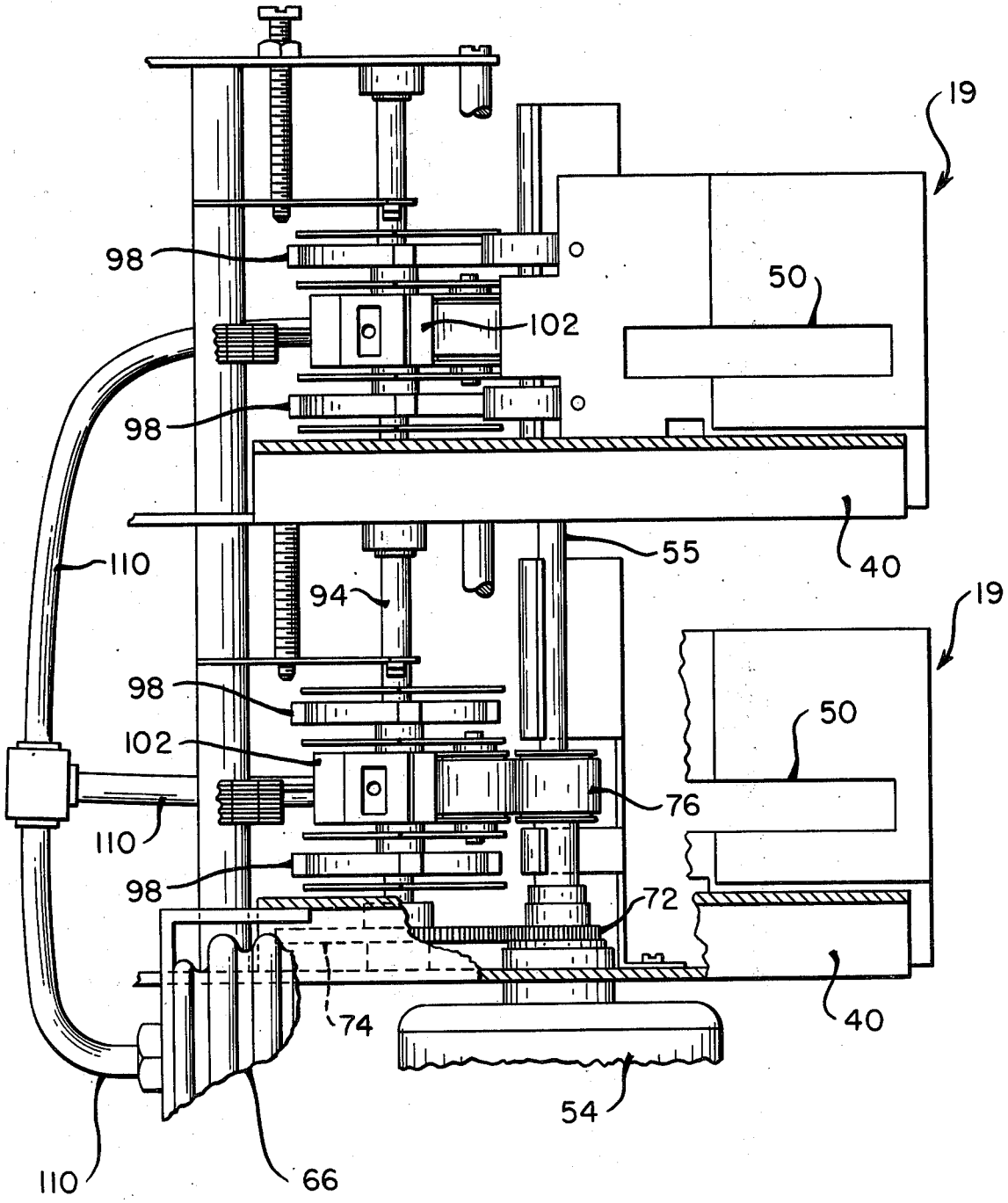
FIG. 8 is a view showing a plurality of feed devices in stacked relationship, utilizing a common driving means and vacuum means.

The hopper 20 may be either completely removable as a cartridge from the record media feeding device 19, or may be slightly mounted on a frame 40 (FIG. 1) by means of headed studs 35 and 37 on the base 22 of the hopper 20, cooperating with slots 39 and 41 in the frame 40, so as to allow said hopper to be moved back out of engagement with the feeding mechanism for purposes of refilling with currency or record members. The hopper 20 is retained in operative position on the frame 40 against undesired movement for record member feeding operation by means of a suitable latch, such as the latch 43 (FIG. 1). It should be noted that a number of the feeding devices or units may be stacked to form a multiple bill currency dispenser 18, utilizing a common motor and vacuum system, as shown in FIG. 8. In such a case, some means of removal or shifting of position of the hopper 20 is necessary in order to obtain access to said hopper for refilling thereof with currency or other record members.

It should also be noted that the feeding device is adaptable to feeding record members, including currency, of different lengths. This can readily be accomplished by changing the position of the left hopper side wall 24 with respect to the other side wall, so as to alter the distance therebetween, and thereby accommodate record members of different lengths.

Figure 5:
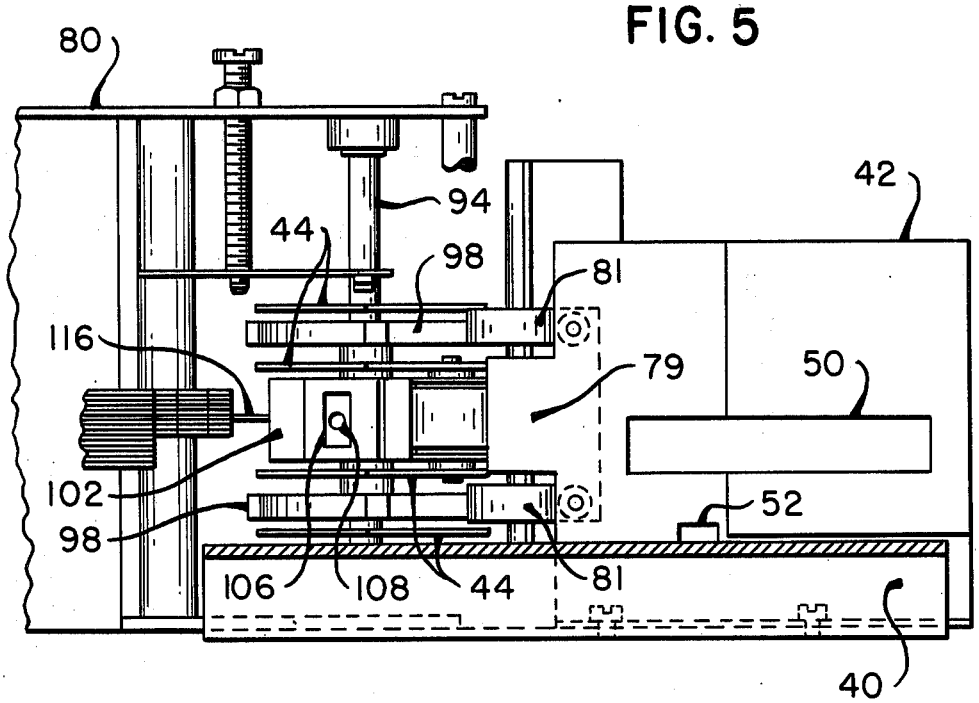
FIG. 5 is a sectional view, taken along line 5—5 of FIG. 4.

When the hopper 20 is placed into operative position in the feeding device 19, the record members are displaced backward against the force of the springs 36, by engagement with a table 42 having a friction surface 43 thereof, fixed to the base member 40, on the left side as seen in FIG. 1, and by engagement with the upper ends of a plurality of arms 44 pivotally mounted on a shaft 46 and urged by a spring 48 into the position in which they are shown in FIG. 1. The end wall 28 passes through an aperture 50 (FIG. 5) in the table 42, and the record members 27 therefore no longer engage said end wall. The record members 27 also normally no longer engage the end wall 30 when the hopper has been shifted into operative feeding position, although end portions of the record members may in some instances contact a portion of said end wall. Slots 45 (FIG. 12) in the end wall 30 provide clearance for the downwardly curving rear end portions of the upper ends of the arms 44, in order to prevent possible interference between said end wall and said arms. The slide strips 29, 31 retain the record members 27 in proper position in the hopper 20, the strip 29 passing through an aperture 52 (FIG. 5) in the table 42.

Figure 2:
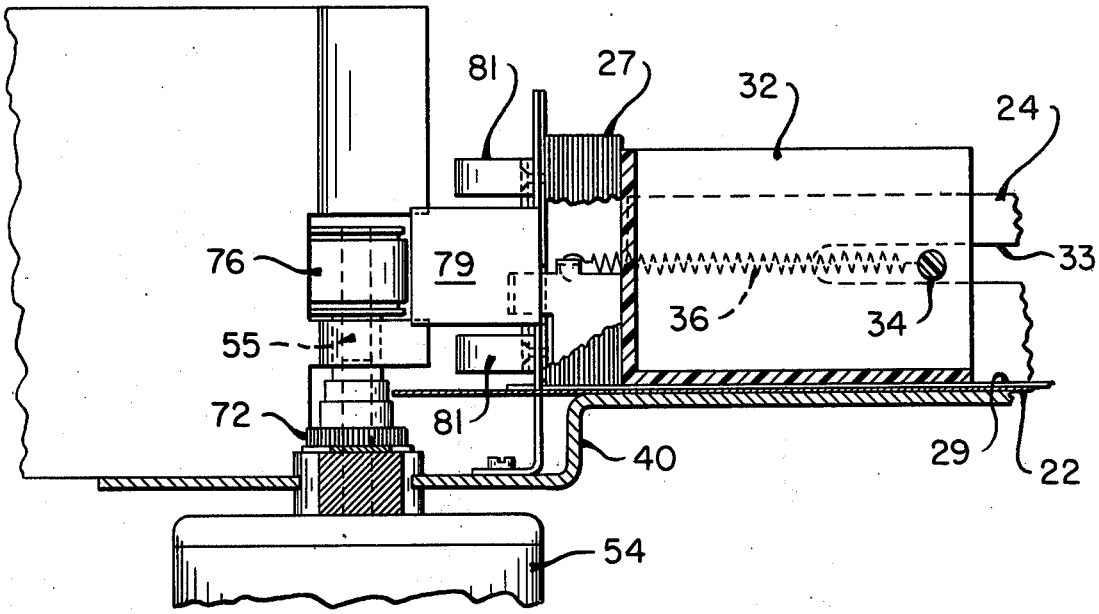
FIG. 2 is a sectional view, taken along line 2—2 of FIG. 1.
Figure 3:
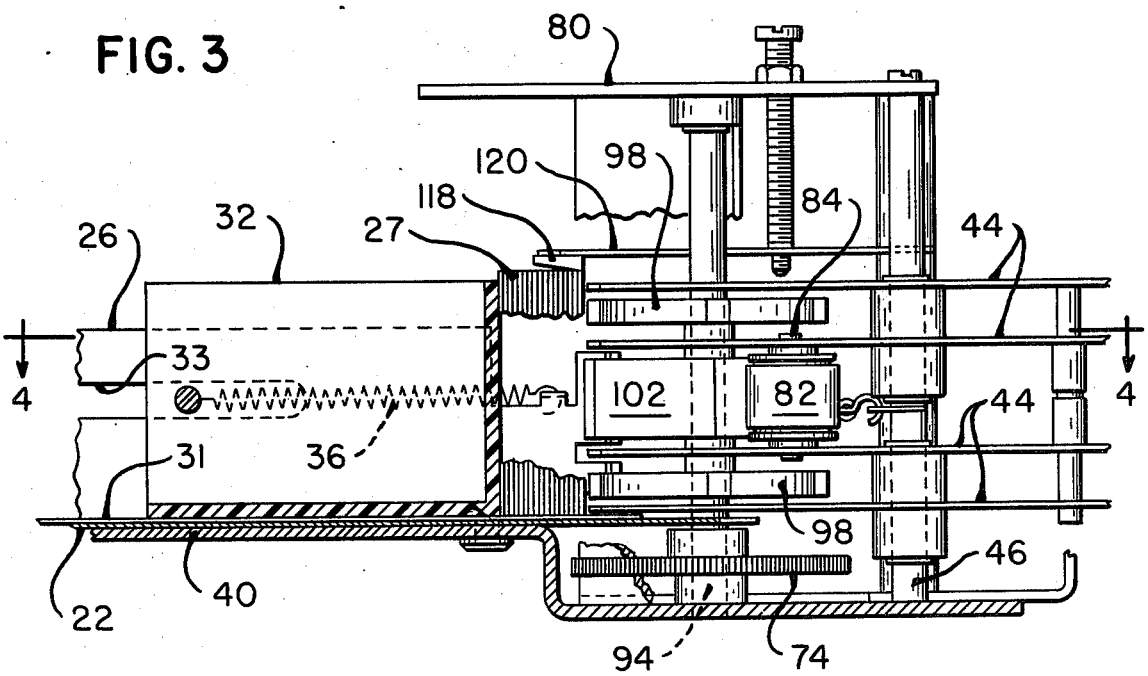
FIG. 3 is a sectional view, taken along line 3—3 of FIG. 1.
Figure 4:
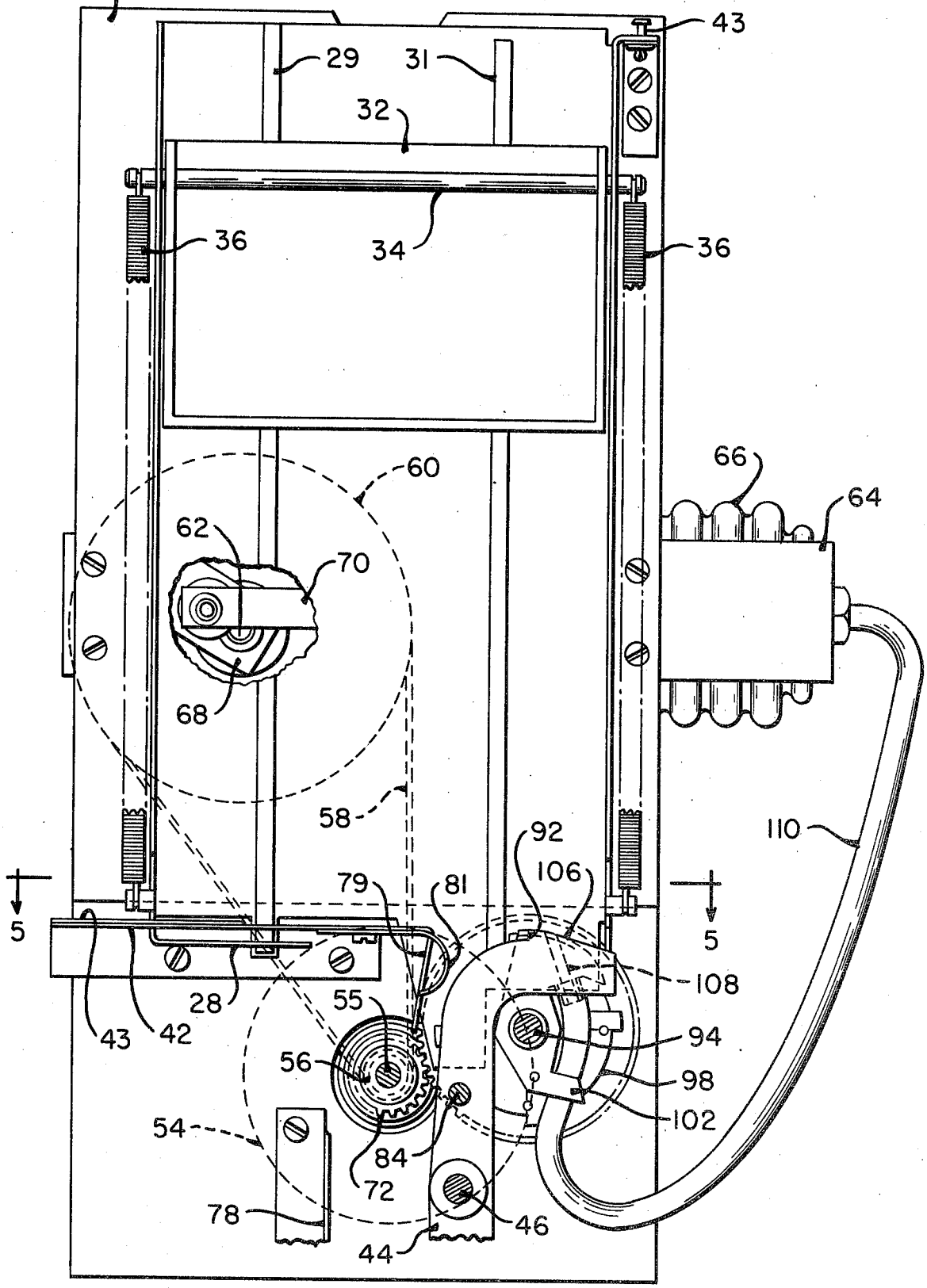
FIG. 4 is a sectional view, taken along line 4—4 of FIG. 3, also showing certain portions of the driving and vacuum mechanisms.

Secured to the frame 40 on the opposite side thereof from the hopper 20, as best shown in FIGS. 2 and 4, is a motor 54 which provides the driving power for the feeding device of the present invention. A pinion 56 at one end of the motor shaft 55 drives a toothed belt 58 which in turn drives a gear 60 fixed to a shaft 62 rotatably mounted in a bracket 64 fixed to the base member 40. Also mounted on the bracket 64 is a vacuum pump 66 driven by the shaft 62 through an eccentric 68 on said shaft and an arm 70 connected to said eccentric and to the pump 66. The pump 66 operates continuously during the time that the motor 54 is running, providing alternating pressure and vacuum stroke outputs, for a purpose which will subsequently be described. In the illustrated embodiment, the pump 66 is capable of reducing atmospheric pressure by 10 inches of mercury, and has a displacement of 85 milliliters. At the other end of the motor 54, a pinion 72 is fixed on the shaft 55 which extends through the frame 40, said pinion meshing with a gear 74 (FIG. 3). Also at this end of the shaft 55, a feed roller 76 (FIG. 1) is fixed.

A guide 78, fixed to the frame 40, is slotted and angled at its upper end to partially surround the roller 76. An angled extension of the table 42 provides a guide 79 which cooperates with the guide 78 in restricting the path of movement of record members 27 during a feeding operation, as will subsequently be described. Two relatively flexible spring arms 81 (FIG. 2), disposed at either side of the guide 79, and secured to the table 42, urge record members 27 to the right, as viewed in FIG. 1, as they are being fed.

A bracket 80, fixed to the frame 40, provides bearings and support for a number of components of the feeding device. The shaft 46, upon which the arms 44 are pivotally mounted, is journaled at one end in the frame 40 and at the other end in the bracket 80. An idler roller 82, rotatably mounted on a shaft 84 journaled in two of the arms 44, is urged into cooperating engaement with the feed roller 76 by the spring 48. As previously mentioned, the upper ends of the arms 44 are positioned to engage the exposed record member 27, and are each provided with a notch 92 to prevent retrograde movement of said record member 27 during a feeding operation, as will subsequently be described.

Figure 11:
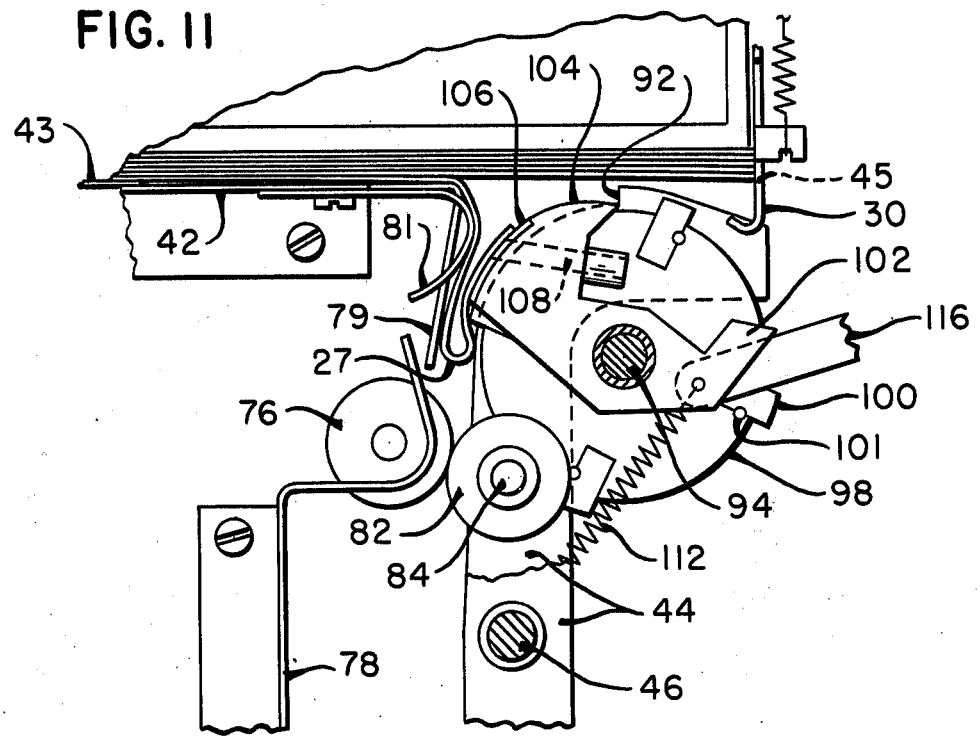

A shaft 94, journaled in the frame 40 and the bracket 80, is driven by the gear 74 fixed thereto, which meshes with the pinion 72 fixed to the motor shaft 55. A pair of spaced-apart driving wheels 98, each located between two adjacent arms 44, are fixed to the shaft 94 to be driven thereby. Each of the wheels 98 is provided with a plurality (four in the illustrated embdiment) of projections 100 of a resilient high friction material, which may be secured in position by pins 101 or in any other suitable manner, for imparting movement to the record member 27 which is being fed. Riding free on the shaft 94, positioned between the wheels 98, is a pusher arm 102. An upper curved surface 104 of the arm 102 is provided with a friction pad 106 (FIG. 4) to facilitate gripping of a record member 27, and is also provided with an aperture 108 extending through said friction pad, to which the vacuum pump 66 is connected by suitable means, such as a tube 110. The pusher arm 102 is normally held in the position in which it is shown in FIG. 1 by the action of a spring 112 connected between said arm and the shaft 46. The arm 102 can be selectively shifted from said position to a second position in which it is shown in FIG. 11, during the course of a record member feeding operation, by means of a solenoid 114 fixed to the frame 80, said solenoid being connected to the pusher arm 102 by a link 116.

During record member feeding operations, the stack of record members 27 is maintained in proper position by a guide finger 118 fixed to one end of a spring arm 120 mounted on the bracket 80.

Figure 7:
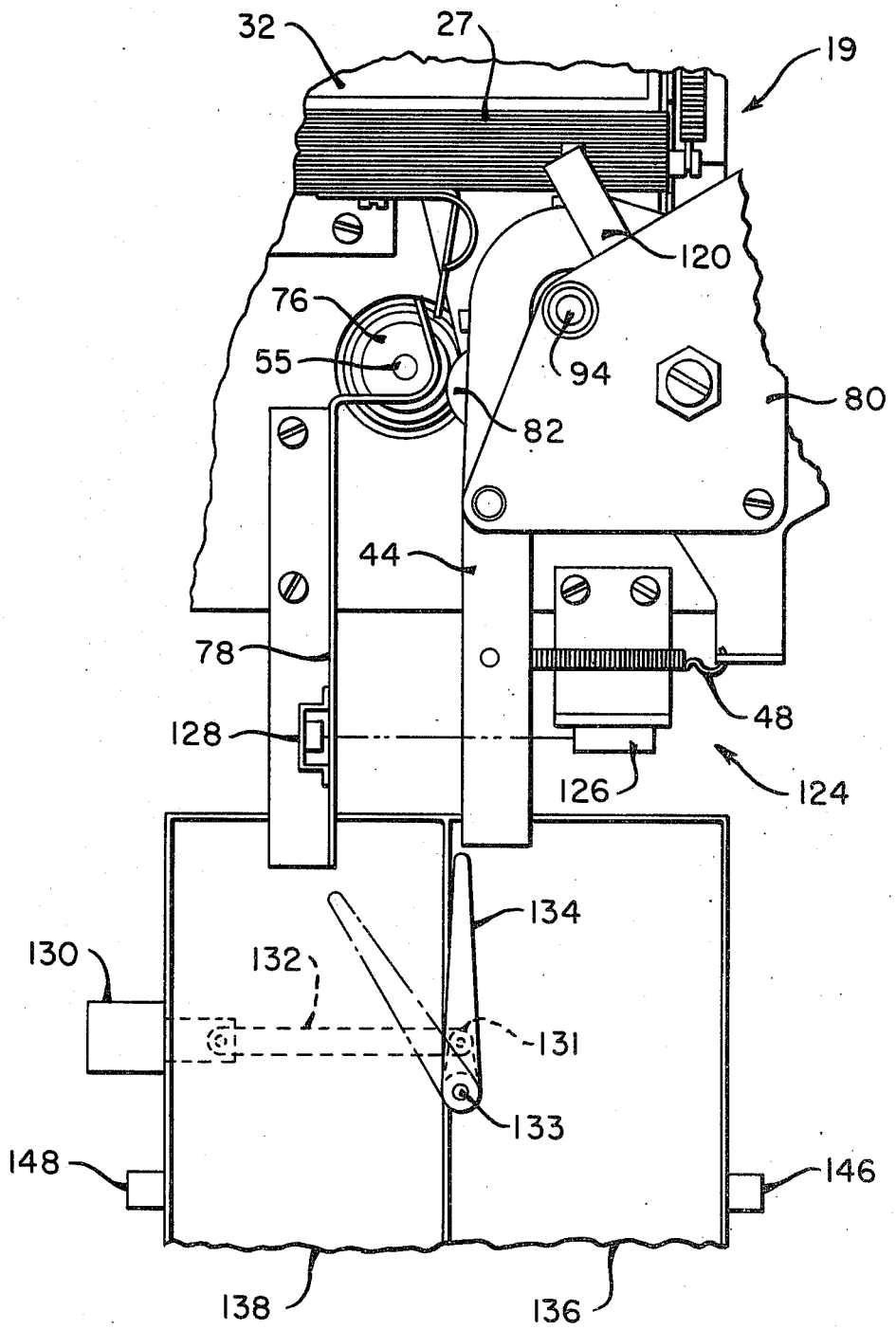
FIG. 7 is a diagrammatic showing of the feeding mechanism, including a "doubles" detector and means for diverting improperly fed record members to a secondary location.
Figure 13:
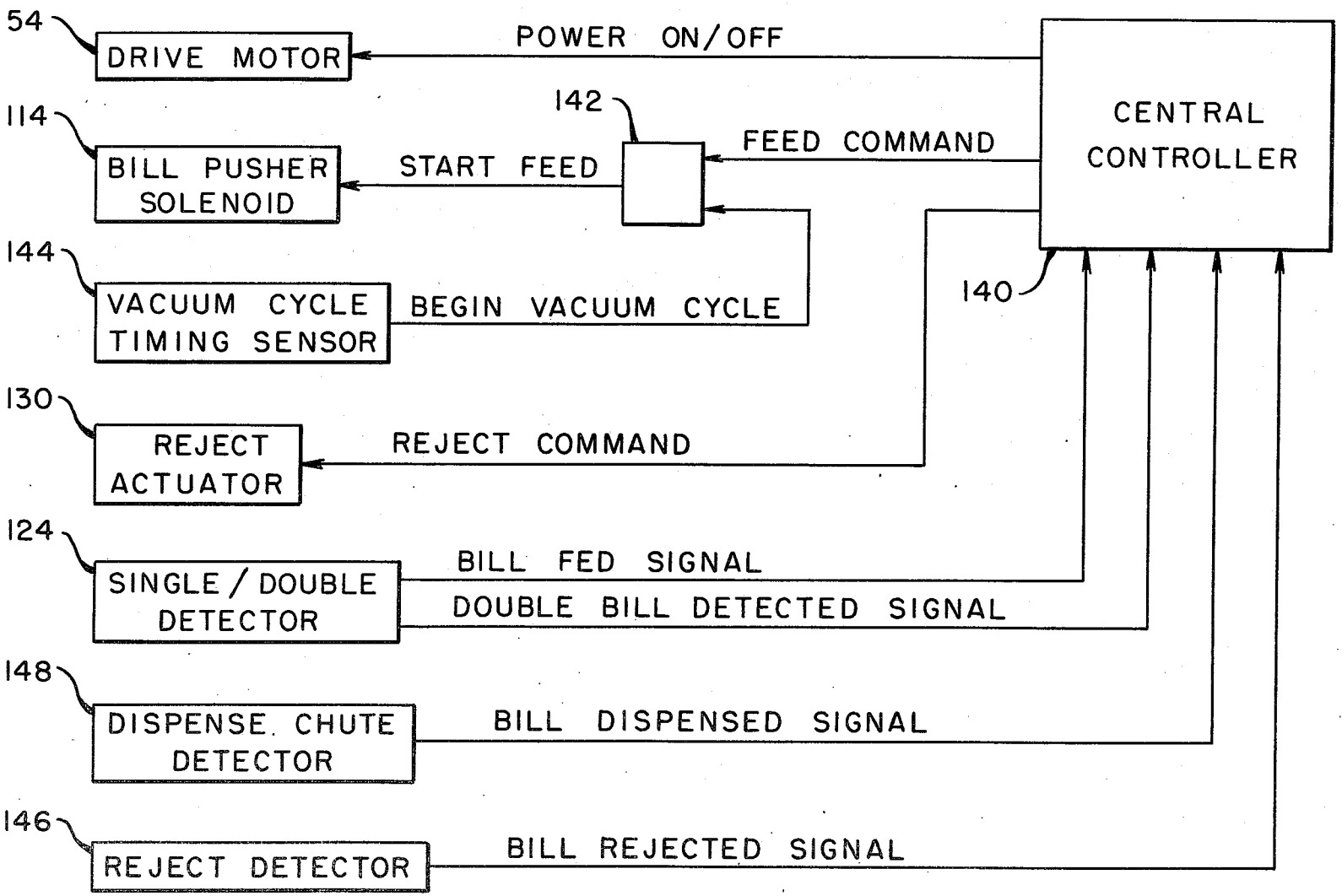
FIG. 13 is a schematic block diagram showing the interconnections of the various elements of a record member feeding device with a central controller for coordination of the operation of said elements in feeding operations.

As seen in FIG. 7, means may be provided to detect the improper feeding of more than one record member at a time, and to cause the improperly fed record members to be diverted to an alternate destination. These means include a "doubles" detector 124, which may be of any one of several known types. In the illustrated embodiment, the detector 124 includes a radiation source 126 and a radiation detector 128. Assuming that the record member 27 will have some degree of translucency, the radiation impinging on the detector 128 will be of one intensity when no record members are passing between the source 126 and the detector 128, will be of a second lesser intensity when a single record member 27 passes therebetween, and will be of a still lower intensity if two or more record members simultaneously pass therebetween. The detection of a "double" or multiple record member feed can therefore be readily detected. Detection of such a condition can energize a solenoid 130, which is effective through a link 132 pivotally attached to an eccentric 131 fixed on a shaft 133 to shift a gate 134 also fixed on the shaft 133 to cause the improperly fed record members to be diverted to an alternate location in a "reject" chute 136, instead of the chute 138 into which it would be directed following a correct feeding of only a single record member 27. Detectors 146 and 148 may be provided to detect the passage of record members through the chutes 136 and 138, and may be coupled to the central controller 140, as shown in FIG. 13, in order to enable a count of such record members to be maintained, or for other purposes, as desired.

Operation of the feeding device of the present invention will now be described, with particular reference to the fragmentary views of FIGS. 9, 10, 11 and 12, and the block diagram of FIG. 13.

During operation of the feeding device 19, the motor 54 is constantly operating, driving the shafts 55 and 94 and the vacuum pump 66. Therefore the feed roller 76, the idler roller 82 driven by the roller 76, and the driving wheels 98 are constantly rotating, and alternating vacuum and pressure cycles are applied from the pump 66 through the tube 110 to the aperture 108 and the pusher arm 102.

Figure 9:
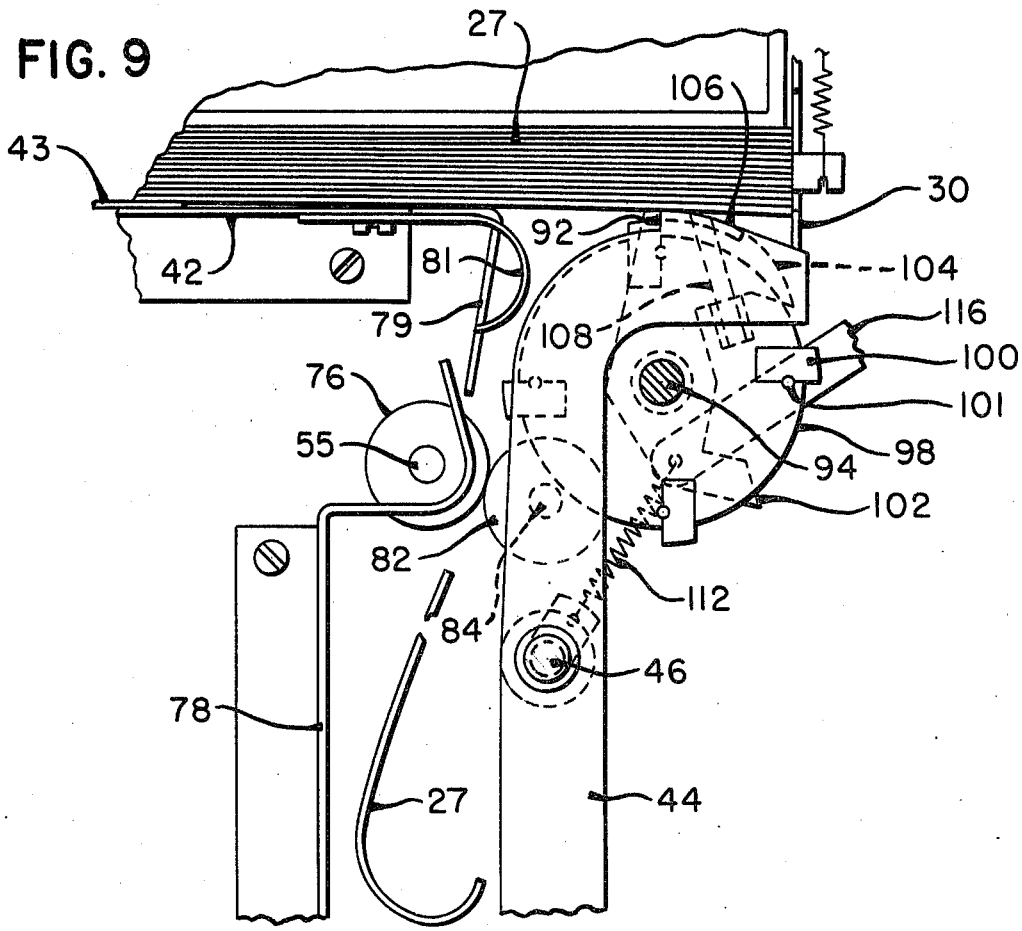
FIGS. 9, 10, 11 and 12 are fragmentary plan views showing the record member picking and transporting means in a plurality of operating positions during different stages of the transporting of a record member from its storage hopper to its destination.

In FIG. 9, the pusher arm 102 is shown in the position in which it rests prior to the commencement of a record member feeding operation. A record member 27 which has just been fed through the rollers 76, 82 is shown in the space between the guide 78 and the arms 44. The next record member 27 to be fed is at the end of the stack in the hopper 20, with about half of the total area of said record member being pressed against the table 42 and the friction surface 43 thereon by the spring-urged shoe 32. The opposite end of the bottom record member 27 is supported by the upper ends of the arms 44. The upper apertured end of the pusher shoe 102 is disposed between the inner two arms 44, and as the alternating vacuum and pressure cycles of the pump 66 occur, the bottom record member will be alternatingly drawn toward and blown away with a very small positive gage pressure from said end of the shoe 102, but no feeding will take place. The bottom record member 27 is held by the arm 44 out of engagement with the projections 100 on the rotating wheels 98.

Referring to FIG. 13, let it now be assumed that a record member feed command signal is generated by a central controller 140 capable of controlling the operation of the feeding device 19. The central controller 140, may, for example, be part of an automated teller machine which is caused to generate a bill feed signal during a customer withdrawal operation. The feed command signal is applied to one input of a gate 142, the other input of which is connected to a vacuum timing cycle sensor, which is caused to generate a signal at an appropriate time during the cycle of operation of the pump 66. In the illustrated embodiment, the "zero point" of operation is considered to be when the pump bellows is fully compressed. At approximately 100 mechanical degrees of rotation from that "zero point", subject to adjustment in accordance with the characteristics of the record members being fed, the vacuum has reached a near-peak value, and causes the sensor 144 to generate a signal which is applied to the gate 142. The two signals applied to said gate cause the bill pusher solenoid 114 to be energized, which acts through the link 116 to rock the pusher arm 102 in a counterclockwise direction about the shaft 94 on which it is rotatably mounted.

Figure 10:
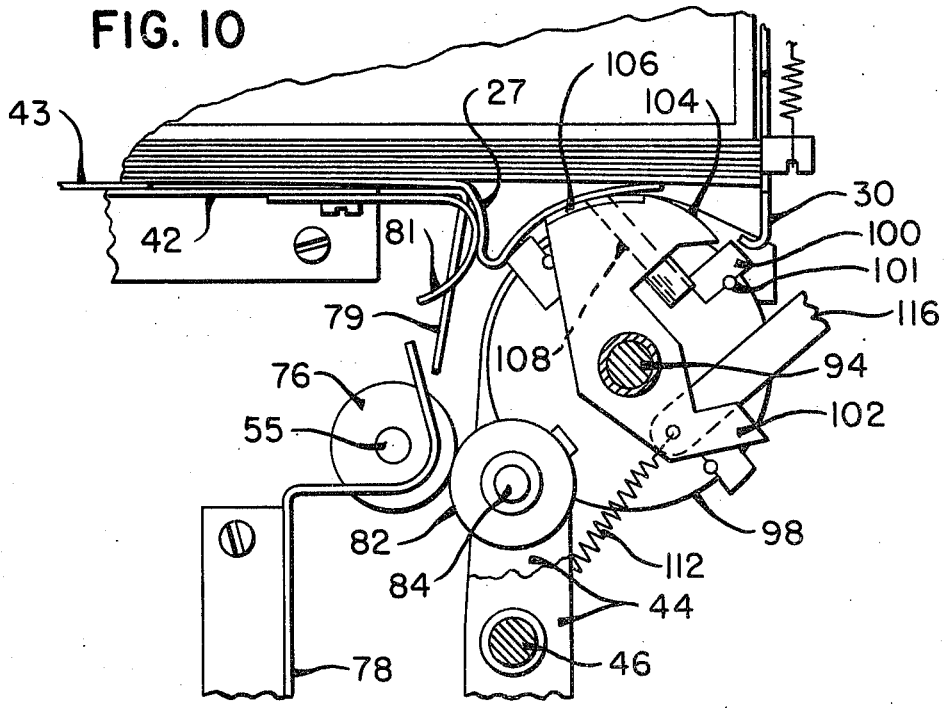

Since the vacuum applied to the aperture 108 in the arm 102 is at a near peak at this time, the right end of the bottom record member 27 is held against the friction pad 106 on the arm 102 and moves with said arm in its counterclockwise movement against the force of the spring 112. The stacked record members 27 rest in the hopper 20 against the left wall 24 so that they cannot move to the left as the arm 102 begins its stroke. The end record member is forced to buckle outwardly at its middle, having no other free direction of movement, while the remaining record members tend to be held in place as a rigid "paper column" which is pushed against the left wall 24. This outward buckling of the end record member greatly assists in separating it from the stack. The mid portion of the record member 27 is thus bent approximately double, as shown in FIGS. 10 and 11, as the movement of the arm continues. The doubled-over portion of the record member 27 is urged to the right, as viewed in FIGS. 9 to 11 inclusive, by the flexible springs 81.

As the arm 102 reaches the point of its further excursion in a counterclockwise direction, the vacuum stroke of the pump 66 concludes and the solenoid 114 is deenergized. This causes the arm 102 to return to the position in which it is shown in FIG. 9, under the urging of the spring 112, while the record member 27 is separated therefrom. This separation may be facilitated by air pressure applied through the aperture 108 as the pump 66 commences its pressure cycle.

Withdrawal of the arm 102 causes the record member 27 to be urged by the springs 81 into engagement with the rotating wheels 98, so that the projections 100 on said wheels engage the end of the record member 27 and drive it in a downward direction as shown in FIGS. 9 to 12 inclusive. Since the rotational speed of the wheels 98 is relatively slow, approximately 10 revolutions per second in the illustrated embodiment, the movement of the end of the record member at this point is relatively slow, and the left end of the record member remains imprisoned between the table 42 and the remainder of the stack of record members 27 held by the pusher shoe 32. Any tendency of the record member 27 to follow the arm 102 in a clockwise direction of return movement is limited by the notches 92 on the arms 44, and by the impacting of the moving projections 100 of the wheels 98 on the ends of the record member 27.

Figure 12:
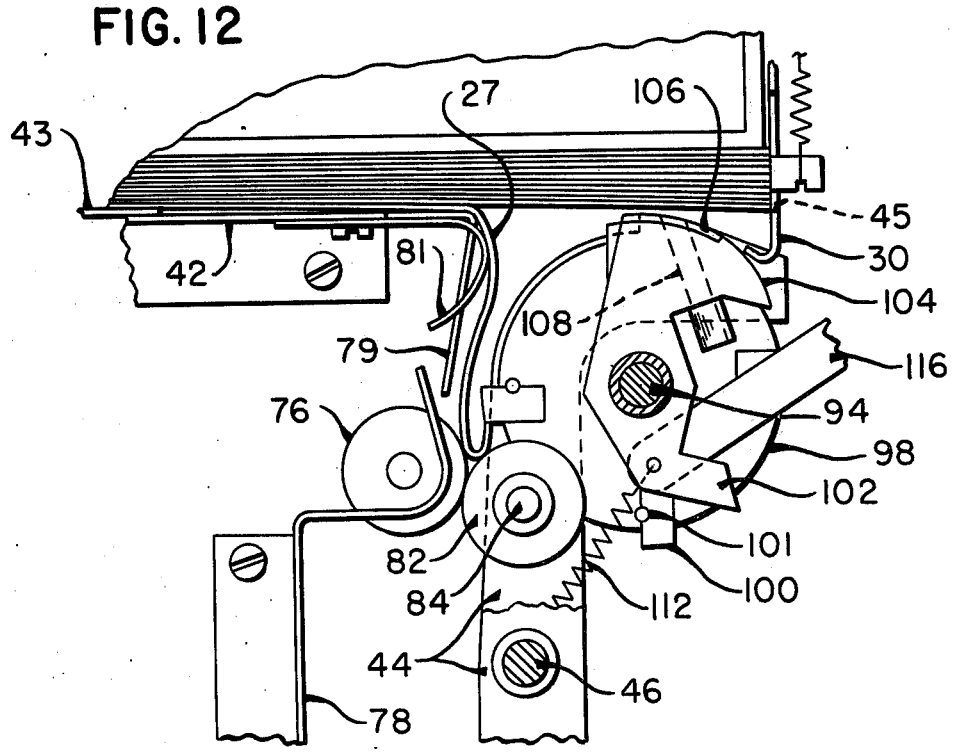

The projections 100 continue to drive the record member 27 downwardly as shown in FIG. 12, until its end, which may be folded over, is driven between the rapidly rotating feed roller 76 and the similarly rotating idler roller 82. At a maximum feed rate of four record members per second and with a rotational velocity of the wheels 98 of approximately ten revolutions per second, as many as ten impacts of the projections 100 are available to bring the end of the record member 27 into engagement with the rollers 76, 82 thus allowing even heavily creased or mutilated record members to be cleared from the feeding device before the next feed cycle.

Once the record member 27 has been driven between the cooperating rollers 76, 82, these rollers, at a speed of 1750 revolutions per minute in the illustrated embodiment, suddenly accelerate the virtually stationary record member to a speed of approximately 100 inches per second, removing the left end of the record member from the stack with a suddenness that does not allow the other record members in the stack to move.

As shown in FIGS. 7 and 9, the fed record member 27 is then directed by the guide 78 and the lower portions of the arms 44 into the chute 138, unless an error condition, such as two record members being fed at the same time, is detected by the doubles detection station 124. In such event, the solenoid 130 is energized and acts through the link 132 to shift the pivotally mounted gate 134 to a position in which it directs the improperly fed record members 27 into the "reject" chute 136.

As previously noted, all motor-driven components, including the driving wheels 98, the feed roller 76 and the pump 66 are driven by the same motor 54 and they operate continuously. The single activation control is through energization of the solenoid 114 whenever it is desired to feed a record member 27, and the only timing requirement is that the solenoid 114 be activated near the peak of the vacuum stroke, which is easily achieved through control means such as the sensor 144 and the gate 142 of FIG. 13.

If desired, as for example in a currency dispenser, a plurality of feeding devices 19, each containing bills of a different denomination, may be stacked one above the other, with all sharing a common drive motor 54, a common pump 66, and common shafts 55 and 94 for the feed roller 76 and driving wheels 98, respectively, as shown in FIG. 8. While only two stacked feeding devices are shown in FIG. 8, a larger number of devices could be stacked, if desired.

In one embodiment, the dispensed bills are driven against the back wall of a vertical receiving chute (not shown) and fall to the bottom for removal. The vertical chutes for both dispensed and rejected bills may be extended upwardly to receive similarly the output of all added dispenser stations, thus bringing all bills to a common collection point without requiring a transport mechanism. In other embodiments, transport mechanisms may be employed to bring the bills to a common collection point. Furthermore, since the various denominations of bills can be dispensed serially, all reject gates can be activated through a common shaft, if it is desired to fix said gates to said shaft and operate the shaft by suitable means, such as the solenoid 130. Because a bill moves only upon activation of the associated solenoid 114, a vacuum may be applied to each of the arms 102 of the multi-bill dispenser continuously during operation of the motor. Consequently, all dispenser units may be attached to a common unvalved vacuum line with the vacuum pump 66 driven from the same motor 54 which powers the remainder of the mechanism.

While the form of the invention described and illustrated herein is particularly adapted to filfill the objects aforesaid, it is to be understood that other and further modifications within the scope of the following claims may be made without departing from the spirit of the invention.

What is claimed is:

1. A record member feeding device for feeding record members from one location to another comprising a hopper in which a plurality of record members may be stored;

first and second spaced-apart supporting means positioned at one end of said hopper defining an opening therebetween;

biasing means operable to urge said record members in the hopper against said first and second spaced-apart supporting means;

a pair of spaced-apart rotatable means on a common shaft positioned in operative relation to said end of said hopper, and having a plurality of projecting means thereon capable of engaging and moving record members brought into contact therewith.

picking means pivotally mounted on said common shaft between said pair of spaced-apart rotatable means and movable between a first position in close proximity to a record member positioned at said end of said hopper and a second position, said picking means including vacuum grasping means for causing a first end of a record member to be carried by said picking means during its movement from said first position to said second position, said record member being held out of engagement with said projecting means on said rotatable means by said first supporting means until said picking means is moved out of said first position;

selectively operable means for causing said picking means to move from said first position to said second position and return; and takeaway means including a pair of cooperating rollers for gripping said first end of the record member after transportation by the picking means and the rotatable means and further transporting said record member;

whereby said grasped record member is removed from said hopper through said opening and transported to another location, said second end of said record member being held in engagement with said second supporting means until the first end of said record member is gripped and transported by said takeaway means.

2. The record member feeding device of claim 1, also including a first receptacle to which record members taken from said hopper may be transported.

3. The record member feeding device of claim 2, also including a reject receptacle and a reject gate capable of selectively directing transported record members into said reject receptacle rather than said first receptacle.

4. The record member feeding device of claim 3, also including detecting means for detecting when more than one record member is simultaneously transported, said detecting means being capable of activating said reject gate to cause said more than one simultaneously transported record member to be directed into said reject receptacle.

5. The record member feeding device of claim 1, also including resilient means for urging the record member being fed into engagement with the rotatable means.

6. The record member feeding device of claim 1 in which the selectively operable means comprises a solenoid.

7. A currency dispensing device comprising a plurality of hoppers in which bills of different denominations may be stored;

first and second spaced-apart supporting means positioned at one end of each hopper defining an opening therebetween;

biasing means operable to urge said bills in each hopper against said first and second spaced-apart supporting means;

a pair of spaced-apart rotatable means on a common shaft positioned in operative relation to said end of each hopper, and having a plurality of projecting means thereon capable of engaging and moving bills brought into contact therewith;

picking means pivotally mounted on said common shaft between said pair of spaced-apart rotatable means and movable between a first position in close proximity to a bill positioned at said end of each hopper and a second position, said picking means including vacuum grasping means for causing a first end of a bill to be carried by said picking means during its movement from said first position to said second position, said bill being held out of engagement with said projecting means on said rotatable means by said first supporting means until said picking means is moved out of said first position;

selectively operable means for causing said picking means to move from said first position to said second position and return; and takeaway means including a pair of cooperating rollers for gripping said first end of the bill after transportation by the picking means and the rotatable means and further transporting said bill;

whereby said grasped bill is removed from said hopper through said opening and transported to another location, said second end of said bill being held in engagement with said second supporting means until the first end of said bill is gripped and transported by said takeaway means.

8. The currency dispensing device of claim 7, also including a first receptacle to which bills taken from said hopper may be transported.

9. The currency dispensing device of claim 8, also including a reject receptacle and a reject gate capable of selectively directing transported bills into said reject receptacle rather than said first receptacle.

10. The currency dispensing device of claim 9, also including detecting means for detecting when more than one bill is simultaneously transported, said directing means being capable of activating said reject gate to cause said more than one simultaneously transported bill to be directed into said reject receptacle.

11. The currency dispensing device of claim 7, also including resilient means for urging the bill being fed into engagement with the rotatable means.

12. The currency dispensing device of claim 7 in which the selectively operable means comprises a solenoid.

* * * * *